US012616275B2

(12) United States Patent
Poëll

(10) Patent No.: US 12,616,275 B2
(45) Date of Patent: May 5, 2026

(54) BENDABLE SHOE

(71) Applicant: Björn Poëll, Auboranges (CH)

(72) Inventor: Björn Poëll, Auboranges (CH)

( * ) Notice: Subject to any disclaimer, the term of this patent is extended or adjusted under 35 U.S.C. 154(b) by 10 days.

(21) Appl. No.: 18/314,372

(22) Filed: May 9, 2023

(65) Prior Publication Data

US 2023/0389649 A1 Dec. 7, 2023

(30) Foreign Application Priority Data

Jun. 3, 2022 (EP) ..... 22177333

(51) Int. Cl.
*A43B 13/14* (2006.01)
*A43B 11/00* (2006.01)

(52) U.S. Cl.
CPC ..... *A43B 13/141* (2013.01); *A43B 11/00* (2013.01)

(58) Field of Classification Search
CPC ..... A43B 11/00; A43B 13/141; A43B 13/37
USPC ..... 36/138
See application file for complete search history.

(56) References Cited

U.S. PATENT DOCUMENTS

| | | | | |
|---|---|---|---|---|
| 5,481,814 | A | 1/1996 | Spencer | |
| 6,189,239 | B1 * | 2/2001 | Gasparovic | A43B 13/141 36/102 |
| 11,000,091 | B1 * | 5/2021 | Kyle | A43B 13/143 |
| 11,154,115 | B2 * | 10/2021 | Bruno | A43B 23/0295 |
| 11,185,125 | B2 * | 11/2021 | Blanche | A43B 13/37 |
| 2010/0251572 | A1 * | 10/2010 | Baudouin | A43B 11/00 36/105 |
| 2018/0110287 | A1 * | 4/2018 | Hopkins | A43B 23/0295 |
| 2018/0263332 | A1 * | 9/2018 | Bruno | A43B 21/32 |
| 2020/0205512 | A1 * | 7/2020 | Blanche | A43B 3/246 |
| 2021/0112924 | A1 * | 4/2021 | Hopkins | A43B 3/246 |

FOREIGN PATENT DOCUMENTS

| | | | | |
|---|---|---|---|---|
| DE | 102009023689 | A1 | 12/2010 | |
| DE | 202016001813 | U1 | 6/2017 | |
| EP | 1952715 | A1 | 8/2008 | |
| WO | WO-2010139456 | A1 * | 12/2010 | A43B 11/00 |
| WO | WO-2020020943 | A1 * | 1/2020 | A43B 11/00 |

OTHER PUBLICATIONS

Schwarz et al., Shoe having Dressing Aid: (translation), Clarivate Analytics, 2010 (Year: 2010).*

Neumeyer et al., "Shoe with Step-in Aid and Method for Producing a Shoe with Step-in Aid" (translation), Clarivate Analytics, 2020 (Year: 2020).*

Search Report received in European Application No. 22177333, dated Oct. 10, 2022.

* cited by examiner

*Primary Examiner* — Haley A Smith
(74) *Attorney, Agent, or Firm* — Knobbe, Martens, Olson & Bear, LLP

(57) ABSTRACT

A shoe, in particular casual shoe and/or a sneaker for a foot, comprising at least one sole structure, an upper structure, and at least one bending module, wherein the bending module is arranged at least partially within the sole structure, and wherein the sole structure and the bending module are bendable between at least one unbent position and at least one bent position.

16 Claims, 2 Drawing Sheets

BENDABLE SHOE

Figure 1:
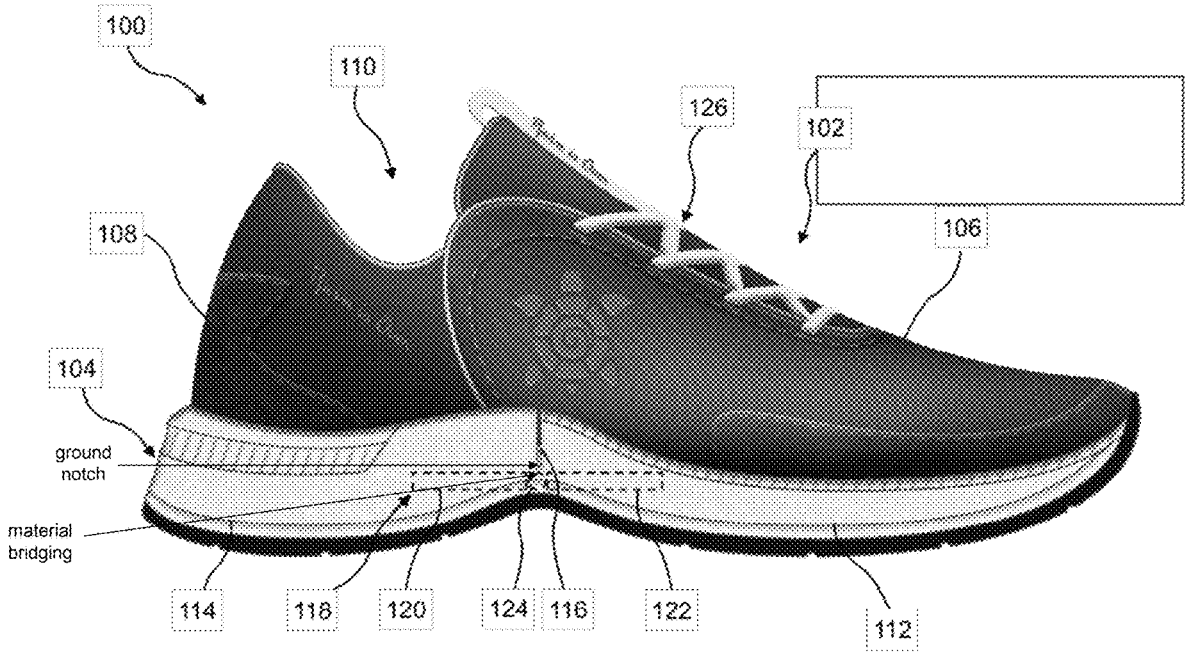

The present invention relates to a bendable shoe, in particular casual shoe and/or a sneaker for a foot.

In practice, it is known that that in order to slip a foot into a shoe, the respective lace usually have to be loosened so that the shoe opening can be widened enough to allow the foot to slip in; if necessary, with the support of a shoe horn which is placed on the inside of the heel cap. After the foot is positioned inside the shoe, it is necessary that the respective lace is tightened in such a way that the shoe structure lies appropriately against the foot, especially at the level of the back of the foot. The lacing can be secured e.g. by a loop or special stopper elements.

Conversely, this means that in order to take off a shoe, the lacing security, such as the loop, must first be loosened as well as the respective lace so that the foot can slip out of the shoe or the shoe opening again.

Such a dressing process can be described as laborious and time-consuming, especially if the physical condition of the wearer of the shoe does not or no longer allow unhindered access to his or her own feet.

It is therefore an object of the present invention to provide a bendable shoe which is easy and comfortable to put on and take off.

This object is solved according to the present invention with a bendable shoe according to the features of claim 1. Correspondingly, a bendable shoe, in particular casual shoe and/or a sneaker for a foot, is provided which comprises at least one sole structure, an upper structure, and at least one bending module. The bending module is arranged at least partially within the sole structure, and the sole structure and the bending module are bendable between at least one unbent position and at least one bent position.

The invention is based on the basic idea that a bistable bending module comprising a spring or any other compressible/elastic material and/or a flexible hinge allows, on the one hand, an easy dress procedure of the bendable shoe, when in its bent position, as the shoe opening is widened. On the other hand, the bending module is transferred into its second stable position, namely the unbent position, once the foot exerts a sufficient load to overcome the first stable position, the bent position. In the unbent position, the bendable shoe encloses the foot in such a way that it can be worn without restrictions, i.e. used for walking or running.

A stable position may also be a metastable position.

It may be further provided that the sole structure is held stably in the unbent position or the bent position by means of the bending module.

The bending module is preferably bistable, i.e. it has two stable position one of which is the bent one and the other is the unbent one. In order to be transferred from one of the stable positions to the other, a certain amount of force must be applied to the bending module.

It is also conceivable that the sole structure comprises a front sole portion and a rear sole portion, wherein the front sole portion and the rear sole portion are at least partially separated by a notch.

The notch between the sole portions facilitates the bent position to be adopted and maintained.

However, it is also conceivable that the sole structure does not have a notch if the sole structure is sufficiently elastic or e.g. a tapered material thickness is provided in the area of the metatarsal bridge of the foot forming a hinge area.

Furthermore, it is possible that the notch is located at least approximately at the metatarsal bridge of the foot.

If the notch is at the level of the metatarsus, the flexible shoe can be bent in such a way that the shoe opening is sufficiently widened to allow the foot to slip in or out.

It may be further provided that the sole structure and/or the upper structure are made of an elastic material.

An elastic material allows the shape of the sole structure and/or the upper structure to change during bending without damaging the bendable shoe.

It is also possible that the bending module is arranged in the sole structure substantially at the metatarsal bridge of the foot.

Preferably, the position of the bending module and the notch are aligned to each other so that a bending from one position to the other can be performed without problems.

It is also conceivable that the bending module comprises at least one front element, at least one rear element and at least one bending element connecting the front element and the rear element.

Thus, the bending module can be integrated into or joint to the front and the rear sole portion.

It may further be provided that the bending element is a spring or compressible/elastic material and/or a flexible hinge.

The spring may be leaf spring or spring steel or elastic material that is stamped in such a way that it has a stable and a metastable state.

A spring (e.g. a steel spring, a plastic spring a rubber or elastomer) is bent by the application of force until it suddenly passes through the metastable state by bending or buckling.

In a further possible embodiment of the present invention, the at least one bending element is bistable.

Accordingly, the bending element can be set to two different resting positions.

In another possible embodiment of the present invention, the front element of the bending module is arranged anteriorly of the notch in the front sole portion and the rear element of the bending module is arranged posteriorly of the notch in the rear sole portion.

In yet another possible embodiment, the bending element is arranged at least partially beneath the ground of the notch.

The bending element may also protrude at least partially into the notch.

Preferably, the notch ground and the pivoting point of the bending element are nearly coincident which in particular optimises the bending process of the sole structure.

It is further conceivable that the bending element is at least partially embedded in the sole structure.

It is further possible that the front element and the rear element are aligned to each other in the unbent position so that the bending module is substantially straightened.

In the straightened position, i.e. the unbent position, the bending element is preferably relaxed and the front and rear element are aligned in a common plane.

In another possible embodiment of the present invention, the notch extends from the medial side to the lateral side of the bendable shoe.

To ensure that the shoe, especially the sole structure, is not damaged in the highly stressed zone of the notch when changing positions, it is preferable that the notch is continuous across the longitudinal extension of the shoe.

It is also possible that the upper structure comprises a front shoe portion and a heel cap, wherein the front shoe portion and the heel cap are displaceable to each other, when the sole structure and/or the bending module is bent.

This means that both the front shoe portion and the heel cap can also be inelastic or at least less elastic without the shoe losing its functionality.

It may also be conceivable that the heel cap at least partially overlaps the front shoe portion.

This ensures in particular that a shoe which is brought from the bent to the unbent position is not impaired by a misalignment between the heel cap and the front shoe portion.

In another embodiment of the present invention, a shoe opening is formed by the front shoe portion and the heel cap, wherein the shoe opening has a wider opening angle in the bent position than in the unbent position.

Further details and advantages of the present invention shall now be disclosed in an embodiment according to the invention in connection with the drawing.

Figure 2:
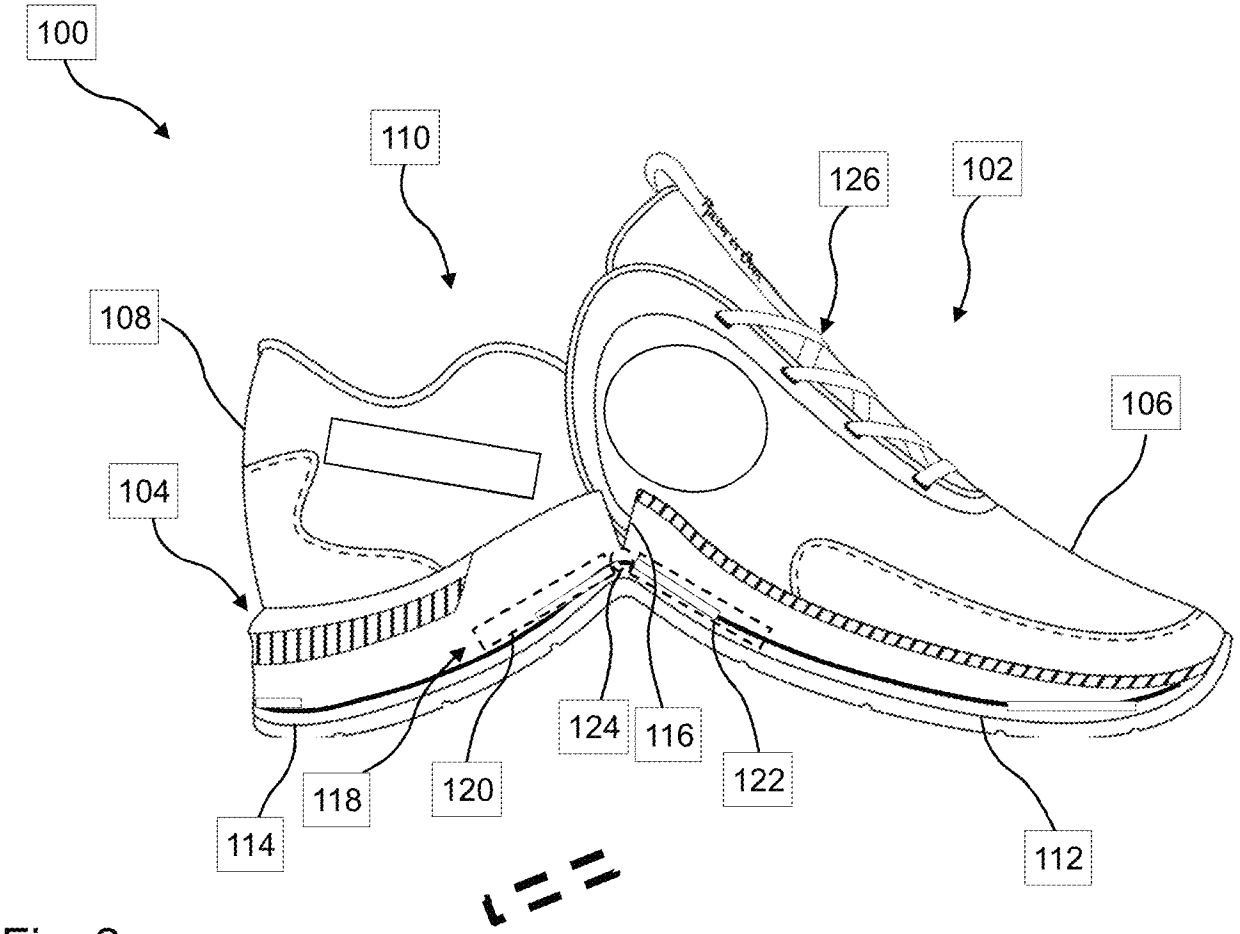

It is shown in:

FIG. 1 a schematic view of an embodiment of a bendable shoe in an unbent position; and FIG. 2 a schematic view of the embodiment of the bendable shoe of FIG. 1 in a bent position.

Identical or functionally equivalent elements are identified with the same reference signs in all figures.

FIG. 1 shows an embodiment of a bendable shoe 100 according to the present invention in an unbent position or basic position.

The unbent position generally corresponds to the configuration of bendable shoe 100 in which the shoe is put on the foot.

The bendable shoe 100 comprises an upper structure 102 and a sole structure 104.

The sole structure 104 is preferably bendable, i.e. in particular elastic.

The upper structure 102 comprises a front shoe portion 106 and a heel cap 108, wherein the front shoe portion 106 and the heel cap 108 form a shoe opening 110 having an opening angle.

The front shoe portion 106 and/or the heel cap 108 are preferably made of an elastic material.

The sole structure 104 comprises a front sole portion 112 and a rear sole portion 114 which are separated by a notch 116.

The notch 116 is preferably arranged at the metatarsal bridge of the foot.

The notch 116 is preferably a V-notch or a slit notch extending from the upper side of the sole structure 104 in direction of lower side of the sole structure 104 for a determined distance so that a sufficient material bridging or joint keeping the front sole portion 112 and the rear sole portion 114 connected is left.

The notch 116 preferably extends fully from the medial side to the lateral side of the bendable shoe.

The bendable shoe 100 further comprises a bending module 118 which is at least partially arranged in the sole structure 104 and which is located substantially at the metatarsal bridge of the foot, when the bendable shoe 100 is put on.

The bending module 118 comprises a rear element 120, a front element 122, and a bending element 124 connecting the front element 122 and the rear element 120.

The bending element 124 is preferably a spring or other compressible/elastic material and/or flexible hinge.

The bending element 124 can preferably be made of a plastic or a metal.

In the unbent position shown in FIG. 1, the rear element 120 and the front element 122 of the bending module 118 are aligned to each other in horizontal plane.

The bending element 124 is arranged approximately beneath the notch 116.

It should be understood that the bending module 118 can either be fully or partially embedded in sole structure 104.

In case of the latter, it is possible that at least one open recess is formed in sole structure 104 such that the bending module 118 is accommodated inside in the at least one recess and that a portion or a surface of the bending module 118 faces outside the sole structure 104. If such recess is open to one side of the sole structure 104, the bending module 118 may be fixed inside the recess by an adhesive or the like.

The bending element 124 of the bending module 118 can be arranged beneath the notch 116, but it is also possible that the bending element 124 protrudes into the notch 116.

The bending element 124 is preferably bistable, i.e. the bending element 124 holds the sole structure 104 and the bending module 118 stable in its bent or unbent position until the stable position is overcome by an exerted force in order to change to the respective other position.

In FIG. 2, the embodiment of the bendable shoe 100 is shown in its bent position.

The bent position generally corresponds to a configuration of the bendable shoe 100 in which the bendable shoe 100 is taken off the foot or ready to slip the foot into the bendable shoe 100.

In the bent position, the sole structure 104 and the bending module 118 are hold stable by the bending element 124 which is preferably bistable.

As a result of the bent position, the opening angle of the shoe opening 110 is widened such that a foot may slip in easy and comfortably.

In the bent position, the heel cap 108 and the front shoe portion 106 of the upper structure 102 do overlap each other less than in the unbent position and the notch 116 is bent open for a defined angle dependent on the stable position of the bending element 124.

The heel cap 108 may overlap the front shoe portion 106 from the inside or the inside. It is also possible that the overlapping configuration of the heel cap 108 is different on the medial side and the lateral side of the bendable shoe 100. For example, the heel cap 108 may overlap the front shoe portion 106 an the medial side of the bendable shoe 100 on the outer side, while in the lateral side of the bendable shoe 100 the heel cap 108 overlaps the front shoe portion 106 on the inside.

The bendable shoe 100 may further comprise a shoelace 126 arranged at the front shoe portion 106 of the upper structure 102 so that the bendable shoe 100 can be additionally secured to the foot, when the bendable shoe 100 is put on.

It is also conceivable that the bendable shoe 100 is laceless, i.e. the material and the dimension of the upper structure 102 are adjusted so that the foot remains securely in the bendable shoe 100, when put on.

In the following, the function of the bendable shoe 100 is described by way of example with reference to FIGS. 1 and 2.

Starting from FIG. 2, a foot can easily be slipped into the bendable shoe 100 in its bent position, as the shoe opening 110 is widened due to the bent sole structure 104 stabilized by the bent bending module 118.

As soon as the foot loads the sole structure 104 sufficiently, the bending module 118 is moved out of its stable bent position and the rear and front elements 120, 122 are straightened in a common plane. This simultaneously reduces the opening angle of the notch 116 and the shoe opening 110.

Once the unbent position, as presented in FIG. 1, is reached, the bending module 118 is fully transferred into its stable unbent position in which the bending element 124 is at least partially unloaded or unstressed.

In the unbent position, the upper structure 102 is preferably close-fitting to the foot, which ideally also includes enclosing the area of the ankle.

In order to take off the bendable shoe 100 the front sole portion 112 is preferably pivoted against the rear sole portion 114 by a movement of the foot, wherein the pivot point is preferably located in the bending element 124. This procedure can be supported by securing or holding the rear sole portion 114 with the other foot or the other bendable shoe 100.

The moment sufficient force is exerted on the bending module 118 or the bending module 124, the stable unbent position is transferred into the stable bent position, wherein the notch 116 and the shoe opening 110 are widened.

As a result, the foot can slide out of the bendable shoe 100 with ease.

REFERENCE SIGNS

100 bendable shoe
102 upper structure
104 sole structure
106 front shoe portion
108 heel cap
110 shoe opening
112 front sole portion
114 rear sole portion
116 notch
118 bending module
120 rear element
122 front element
124 bending element
126 shoelace

The invention claimed is:

1. A bendable shoe for a foot, comprising:

at least one sole structure, an upper structure, and at least one bending module, wherein the at least one bending module is arranged at least partially within the at least one sole structure, and wherein the at least one sole structure and the at least one bending module are bendable between at least one unbent position and at least one bent position, wherein the at least one sole structure comprises a front sole portion, a middle sole portion and a rear sole portion, wherein the front sole portion and the rear sole portion are partially separated by a notch, wherein the notch is a slit notch that is laterally visible in a side view of the shoe and extends from an upper side of the at least one sole structure in direction of a lower side of the at least one sole structure for a determined distance, wherein a remaining part of the front and rear sole portions are not separated by the notch, thereby forming a material bridging between the front sole portion and the rear sole portion at a lower, floor-contacting side of the middle sole portion located at an inflection point between the front and the rear sole portions.

2. The bendable shoe according to claim 1, wherein the at least one sole structure is held stably in the unbent position or the bent position by means of at least one bending module.

3. The bendable shoe according to claim 1, wherein the notch is configured to be located approximately at a metatarsal bridge of the foot.

4. The bendable shoe according to claim 3, wherein the notch extends from a medial side to a lateral side of the bendable shoe.

5. The bendable shoe according to claim 1, wherein at least one of the at least one sole structure and the upper structure are made of an elastic material.

6. The bendable shoe according to claim 1, wherein the at least one bending module is configured to be arranged in the at least one sole structure approximately at a metatarsal bridge of the foot.

7. The bendable shoe according to claim 1, wherein the at least one bending module comprises at least one front element, at least one rear element and at least one bending element connecting the at least one front element and the at least one rear element.

8. The bendable shoe according to claim 7, wherein the at least one bending element comprises a spring, a compressible material, a flexible material, or a flexible hinge.

9. The bendable shoe according to claim 7, wherein the at least one bending element is bistable.

10. The bendable shoe according to claim 7, wherein the at least one front element of the at least one bending module is arranged anteriorly of the notch in a front sole portion and the at least one rear element of the at least one bending module is arranged posteriorly of the notch in the rear sole portion.

11. The bendable shoe according to claim 7, wherein the at least one bending element is arranged at least partially beneath a ground of the notch.

12. The bendable shoe according to claim 7, wherein the at least one bending element is at least partially embedded in the at least one sole structure.

13. The bendable shoe according to claim 7, wherein the at least one front element and the at least one rear element are aligned to each other in the unbent position so that the at least one bending module is substantially straightened.

14. The bendable shoe according to claim 1, wherein the upper structure comprises a front shoe portion and a heel cap, wherein the front shoe portion and the heel cap are displaceable to each other, when the at least one sole structure and the at least one bending module is bent.

15. The bendable shoe according to claim 14, wherein the heel cap at least partially overlaps the front shoe portion.

16. The bendable shoe according to claim 14, further comprising:

a shoe opening formed by the front shoe portion and the heel cap, wherein the shoe opening has a wider opening angle in the bent position than in the unbent position.

* * * * *